US005332948A

United States Patent [19]

True et al.

[11] Patent Number: 5,332,948

[45] Date of Patent: Jul. 26, 1994

[54] X-Z GEOMETRY PERIODIC PERMANENT MAGNET FOCUSING SYSTEM

[75] Inventors: Richard B. True, Sunnyvale; Alan J. Theiss, Redwood City; Douglas B. Lyon, San Carlos, all of Calif.

[73] Assignee: Litton Systems, Inc., Beverly Hills, Calif.

[21] Appl. No.: 883,426

[22] Filed: May 13, 1992

[51] Int. Cl.[5] ..... H01J 25/34

[52] U.S. Cl. ..... 315/3.5; 315/5.35

[58] Field of Search ..... 315/3.5, 5.35, 5.39, 315/39.3; 29/600

[56] References Cited

U.S. PATENT DOCUMENTS

| | | | |
|---|---|---|---|
| 3,188,533 | 6/1965 | Bretting et al. | 315/3.5 X |
| 3,755,706 | 8/1973 | Scott | 315/3.5 |
| 4,057,748 | 11/1977 | Davis | 315/3.5 |
| 4,586,009 | 4/1986 | James | 315/39.3 X |
| 4,800,322 | 1/1989 | Symons | 315/5.39 |
| 4,891,556 | 1/1990 | Iwamoto | 315/39.3 X |
| 4,931,694 | 6/1990 | Symons et al. | 315/3.5 |
| 4,931,695 | 6/1990 | Symons | 315/5.39 |

FOREIGN PATENT DOCUMENTS

| | | | |
|---|---|---|---|
| 53-126254 | 11/1978 | Japan | 315/3.5 |
| 4-71143 | 3/1992 | Japan | 315/39.3 |
| 2119165 | 11/1983 | United Kingdom | 315/5.35 |

*Primary Examiner*—Tony M. Argenbright
*Attorney, Agent, or Firm*—Graham & James

[57] ABSTRACT

An electron beam focusing system is provided within a microwave amplification tube formed from a plurality of magnetic polepieces interposed by non-magnetic spacers. The tube has an axially disposed beam tunnel which permits projection of the electron beam therethrough. A magnetic field is induced in the tube having lines of flux which flow through the polepieces along a magnetic axis. Heat formed within the circuit flows through the spacers to an external planar surface along a thermal axis, which is non-coincident with said magnetic axis. In an alternative embodiment, a plurality of the tubes can be combined into a common system for focusing a plurality of electron beams. The tubes within the common system share heat sinks which attach to the planar surfaces.

30 Claims, 3 Drawing Sheets

FIG. 5
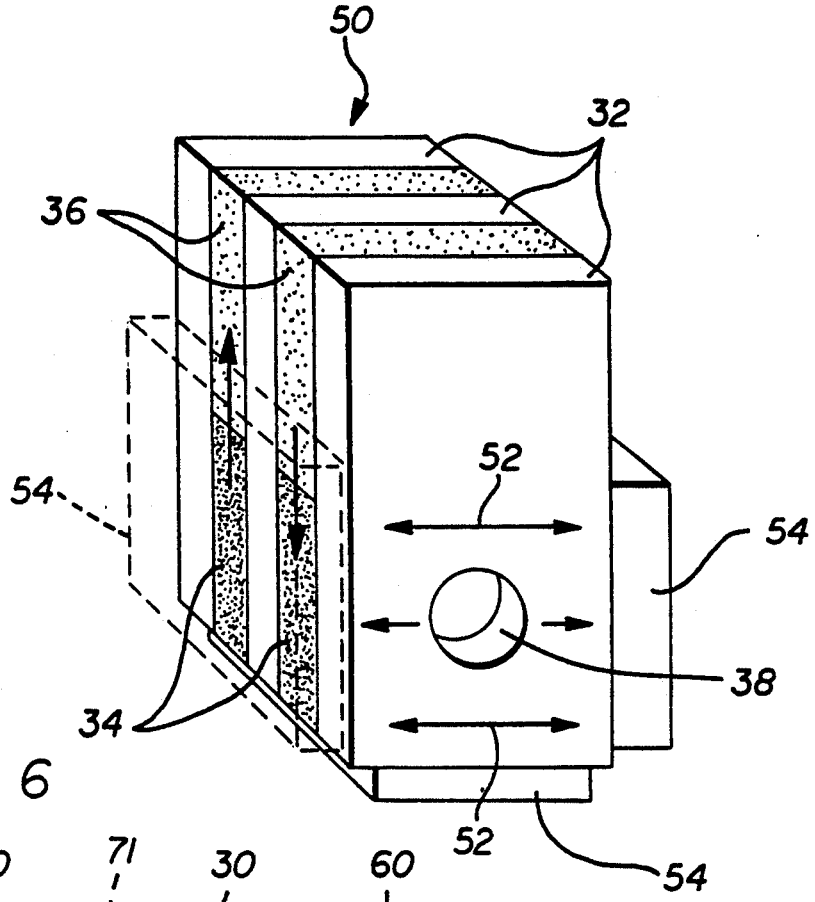
FIG. 6
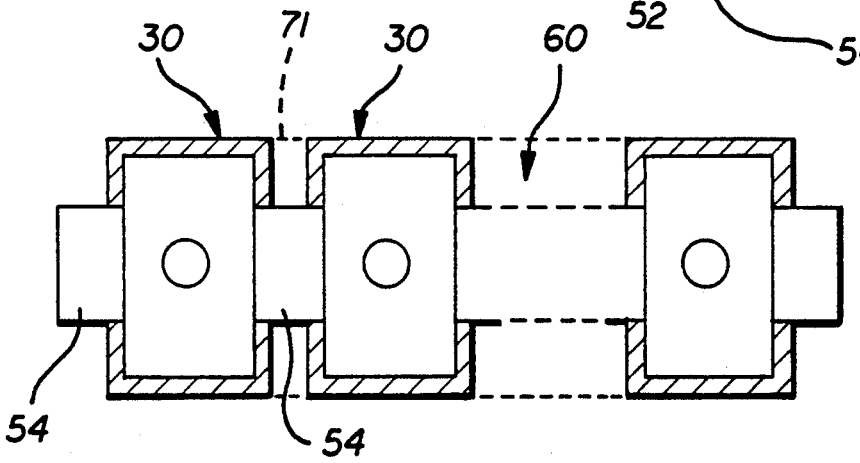
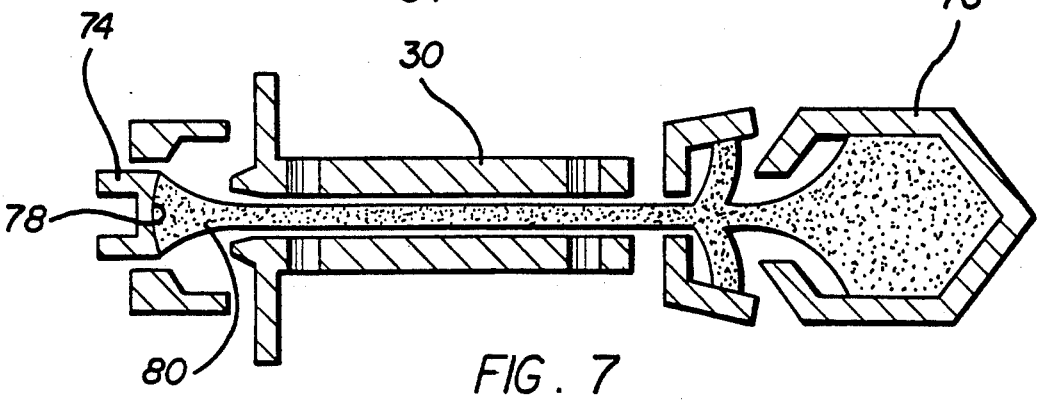
FIG. 7

X-Z GEOMETRY PERIODIC PERMANENT MAGNET FOCUSING SYSTEM

BACKGROUND OF THE INVENTION

1. Field of the Invention

The present invention relates to periodic focusing systems for guiding electron beams, and more particularly, to an alternative geometry for providing periodic focusing of an electron beam in a microwave amplification tube.

2. Description of Related Art

Microwave amplification tubes, such as traveling wave tubes (TWTs), are well known in the art. These microwave tubes, are provided to increase the gain, or amplify, an RF (radio frequency) signal in the microwave frequency range. A microwave RF signal induced into the tube interacts with an electron beam projected through the circuit. Energy within the beam thus transfers into the RF signal, causing the signal to be amplified.

Periodic focusing systems are well known in the art of microwave amplification tubes for guiding the electron beams which pass through beam tunnels within the microwave tubes. Focusing systems of this kind usually consist of ferro-magnetic material known as polepieces, having permanent magnets inserted between them. A microwave amplification tube can either utilize an "integral polepiece" or a "slip-on polepiece." An integral polepiece forms part of a vacuum envelope extending inward towards the beam region, while a slip-on polepiece lies completely outside the vacuum envelope of the tube. The magnets are typically ring-like so as to completely surround the tube or can be button shaped so as to cover azimuthally only portions of the interpolepiece region. In all cases, however, the tube geometry as dictated by the focusing system is essentially cylindrical.

Examples of prior art cylindrical geometry periodic permanent magnet (PPM) focusing systems are shown in FIGS. 1-3. The tubes incorporating prior art PPM focusing systems comprise a plurality of substantially annular polepieces 12 which alternate with non-magnetic spacers 14. The polepieces 12 are commonly formed from iron, while the non-magnetic spacers 14 are typically formed from copper. The polepieces 12 extend radially outward relative the tubes, having ends 15 which join to permanent ring magnets 16 and hubs 13 which form a portion of an electron beam tunnel 17. The polepieces 12 may also be hubless, in which they resemble washers. The circuit tube elements are symmetrical, forming the cylindrical shape shown in FIG. 2, with the electron beam tunnel 17 extending through its center. The configuration of FIG. 1 is known as a single period focusing system, since the polarity of each of the permanent magnets 16 reverses with each adjacent pair of polepieces 12. An alternative configuration is shown in FIG. 3, which discloses a double period focusing system. Interspersed between the polepieces 12 are intermediate polepieces 18. The permanent magnets 16 join each adjacent pair of polepieces 12, spanning two adjacent non-magnetic spacers 14 and an intermediate polepiece 18.

In each of these cylindrical geometry PPM focusing systems, the magnetic flux that enters the polepiece 12 at the boundary with the magnet 16 is first transported radially inward. Magnetic flux that reaches the beam tunnel 17 at an inner radius of the polepiece 12 then jumps axially to its neighboring polepieces, thereby linking the beam tunnel region with a magnetic field to focus the beam. The flux direction inside the polepiece 12 is essentially radial (R) and axial (Z). Accordingly, such cylindrical geometry focusing systems can be referred to as R-Z PPM focusing systems.

These R-Z PPM focusing systems have a desirable feature in that the flux is concentrated at the inside diameter of the polepiece 12, which is often near the region where the beam must be focused. However, these systems also have an inherent limitation which results from the radial length of the circular geometry. In a traveling wave tube which utilizes the R-Z PPM focusing system, an RF path for the microwave signal is provided through the tube. For example, a coupled cavity traveling wave tube would include numerous tuned cavities which determine the bandwidth of the amplified RF signal. The diameter of the ring magnet which surrounds the tube would thus be limited by the required cavity size within the tube. However, as the diameter of the ring magnet system increases to accommodate larger cavities, or the azimuthal position of the pill magnet extends radially outward, the magnetic field strength concentrated in the beam tunnel would decrease. In microwave amplification tubes using high perveance electron guns, the magnetic field strength may be too weak to adequately focus the electron beam.

A related problem with circular geometry PPM focusing systems is that of heat removal. As the electron beam drifts through the beam tunnel 17, heat energy resulting from stray electrons intercepting the tunnel walls must be removed from the tube to prevent reluctance changes in the magnetic material, thermal deformation of the cavity surfaces, or melting of the tunnel wall. Typically, the heat must flow outwardly from the tunnel wall, through the polepieces 12 to a point outside the tube where one or more heat sinks can draw the heat out of the tube. The copper spacers 14 also conduct the heat away from the beam tunnel 17. As with the magnetic flux conduction problem described above, large diameter tubes have a more difficult heat conduction problem in that the heat has further to travel before reaching an external heat sink. Reducing the diameter of the tube would allow the heat to be removed more readily, but would not be compatible with tubes having larger sized coupled cavities.

Consequently, the prior art focusing system forces microwave tube designers to sacrifice both magnetic flux density and thermal ruggedness in order to allow an internal RF path. Thus, it would be desirable to provide a periodic focusing system for a microwave amplification tube which permits either lessening of the thermal resistance of the thermal path from the tunnel wall to the heat sink, or increasing the magnetic flux level at the beam tunnel region, while maintaining a portion of the tube adjacent the tunnel for the RF path or other uses.

SUMMARY OF THE INVENTION

Accordingly, a principle object of the present invention is to provide a periodic focusing system for a microwave amplification tube which provides designers with a trade off between either lessening of the thermal resistance of the thermal path from the tunnel wall to the heat sink, or increasing the magnetic flux level at the beam tunnel region, while maintaining a portion of the tube adjacent the tunnel for the RF path or other uses. Accomplishing this and other objects, there is provided an electron beam focusing system for a microwave amplification tube comprising a tube formed from a plurality of magnet polepieces interposed by non-magnetic spacers. The tube has an axially disposed beam tunnel which permits projection of the electron beam therethrough. The tube further comprises a planar surface disposed on at least one side of the tube, which permits the attachment of a heat sink to the tube. A magnetic field is induced into the tube having lines of flux which flow through the polepieces in a first cartesian direction (X) and which jumps through the beam tunnel in a second cartesian direction (Z) to focus the beam. Heat formed within the tube flows through the spacers to the planar surface in a third cartesian direction (Y) which is perpendicular to both the first and second cartesian directions. The magnetic field is provided by permanent magnets which are disposed externally of the tube and which mechanically couple to the polepieces.

In a first embodiment of the present invention, a tube having a single period PPM focusing system is disclosed, in which adjacent pairs of the polepieces are coupled by individual ones of the permanent magnets. Direction of polarity of the magnets alternates with each adjacent pair of polepieces. The permanent magnets are further disposed on at least one side of the tube that is substantially different from the sides providing the planar surface for receiving the heat sink.

In a second alternative embodiment of the present invention, a tube having a multiple period PPM focusing system is disclosed, in which adjacent triplets of the polepieces are coupled by individual ones of the permanent magnets. Polarity of the permanent magnets alternates with each of the adjacent triplets. The permanent magnets are disposed on at least one side of the tube that is substantially different from the sides providing the planar surface.

In yet another embodiment of the present invention, a plurality of the tubes having the X-Z PPM focusing system are mechanically joined together into a common tube with each adjacent pair of the tubes sharing a common heat sink therebetween. The plurality of tubes could further employ common magnet bars which extend perpendicularly across the tubes. Each of the plurality of tubes would provide focusing for an associated one of the electron beams.

A more complete understanding of the microwave tube having an X-Z geometry PPM focusing system will be afforded to those skilled in the art, as well as a realization of additional advantages and objects thereof by a consideration of the following Detail Description of the Preferred Embodiment. Reference will be made to the appended sheets of drawings which will be first described briefly.

BRIEF DESCRIPTION OF THE DRAWINGS

FIG. 5 is a perspective view of a microwave tube having the X-Z geometry focusing system of the present invention, with permanent magnets disposed at a single end of the circuit;

FIG. 6 is a side view of a multiple electron beam focusing system having a plurality of tubes with each adjacent pair of the tubes sharing a common heat sink;

FIG. 7 is a block diagram of an electron beam focusing system coupled to an electron gun and collector.

DESCRIPTION OF THE PREFERRED EMBODIMENTS

Figure 1:
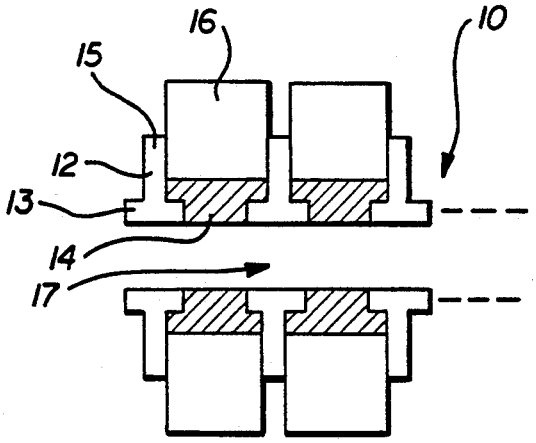
FIG. 1 PRIOR ART
FIG. 1 is a cross-sectional side view of a prior art single period microwave tube utilizing the R-Z cylindrical geometry focusing system.
Figure 2:
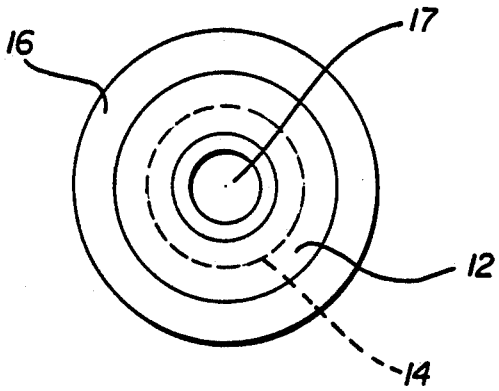
FIG. 2 PRIOR ART
FIG. 2 is an end view of the prior art microwave tube of FIG. 1.
Figure 3:
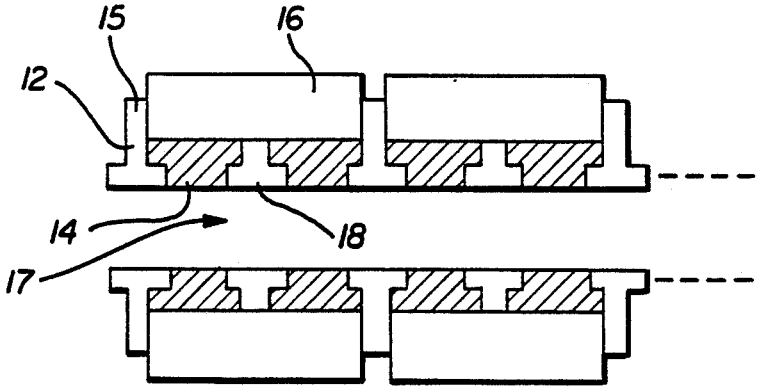
FIG. 3 PRIOR ART
FIG. 3 is a cross-sectional side view of a prior art double period microwave tube utilizing R-Z cylindrical geometry focusing.
Figure 4:
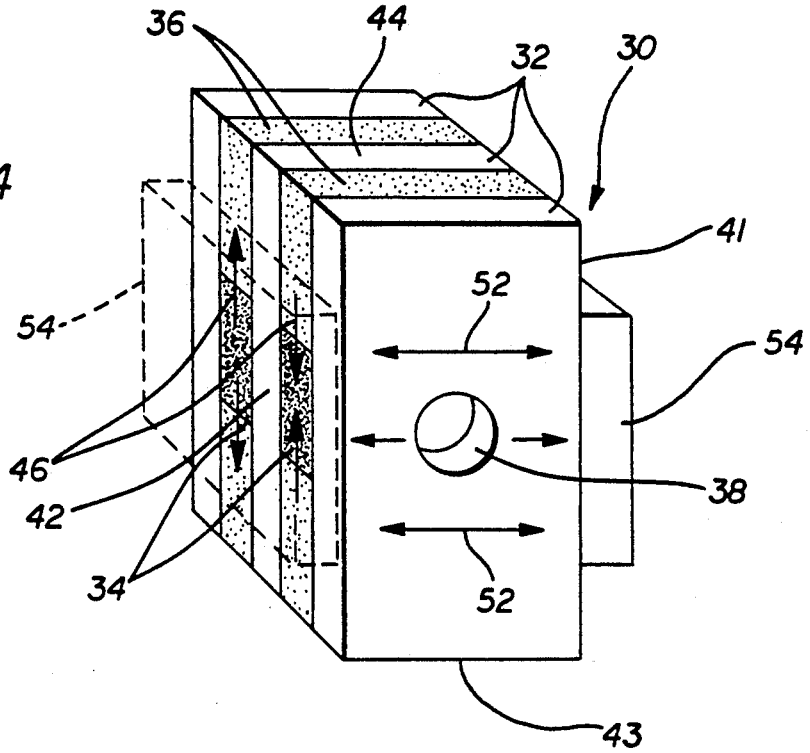
FIG. 4 is a perspective view of a microwave tube having an X-Z geometry focusing system of the present invention.

Referring first to FIG. 4, there is shown a circuit 30 having an X-Z geometry PPM focusing system according to the present invention. The circuit 30 is formed from a plurality of magnetic polepieces 32 interposed by a plurality of non-magnetic spacers 34 which are alternatingly assembled together. The assembled circuit 30 has a polepiece 32 at either end and planar sides 41, 42, 43 and 44. A beam tunnel 38 is shown substantially centered in the end polepiece 32, and extends axially the entire length of the circuit 30. As will be further described below, an electron beam is projected through the beam tunnel 38 and will be focused by the circuit 30.

Each of the magnetic polepieces 32 are generally rectangular or oblong, and are preferably formed from a magnetic conductive metal material, such as iron. The non-magnetic spacers 34 are also generally rectangular, and are formed from a heat conductive material, such as copper. The non-magnetic spacers are interposed between the polepieces 32 extending across a center portion of the polepieces. Permanent magnets 36 are sandwiched between the adjacent polepieces 32 and are provided both above and below the spacers 34. Like the polepieces 32 and the spacers 34, the permanent magnets 36 can have rectangular surfaces such that the entire tube has substantially smooth external surfaces. Alternatively, the magnets 36 can be larger than the polepieces 32 and overhang the side edges of the polepieces. FIG. 4 shows a tube having a single period PPM focusing system, since each of the permanent magnets 36 join adjacent pairs of the polepieces 32. It should be apparent that double or multiple period PPM focusing systems in this general configuration can also be formed having intermediate polepieces 32 of roughly the same size as the non-magnetic spacers 34.

Figure 8:
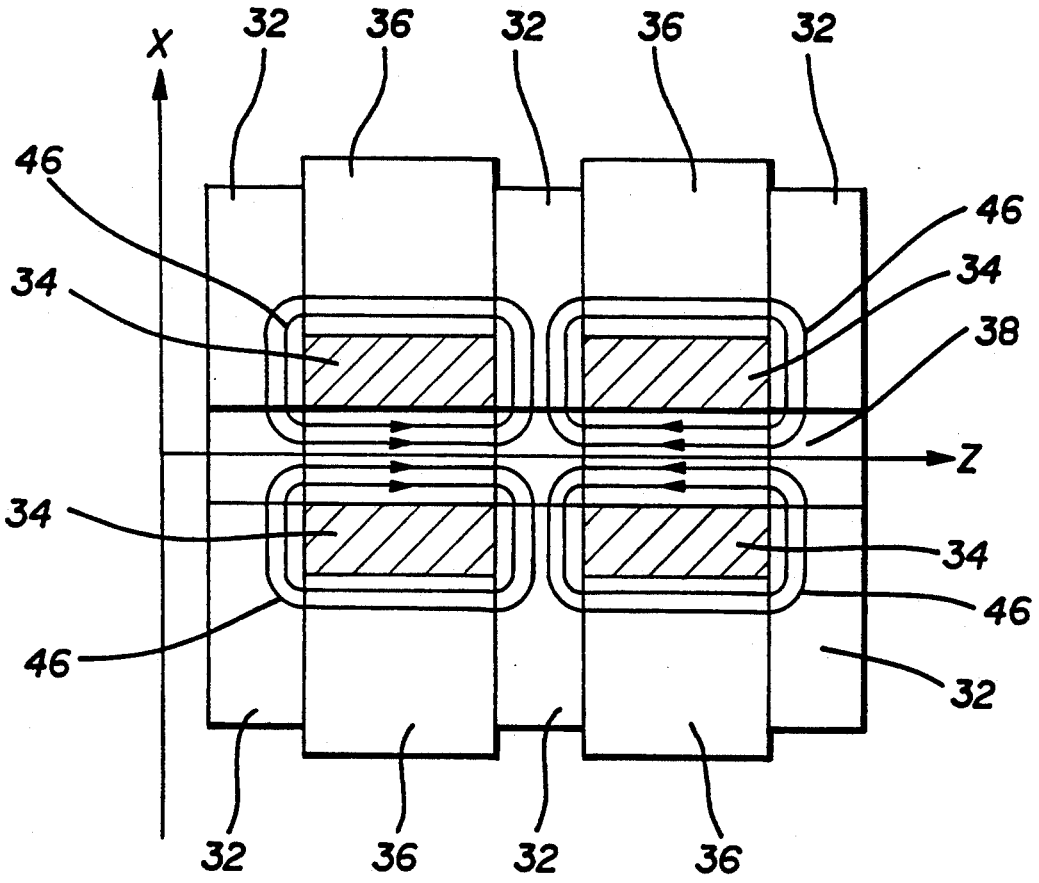
FIG. 8 is a cross-sectional view of the microwave tube having the X-Z geometry focusing system, showing magnetic flux lines.

As in the prior art focusing systems, the magnets 36 are intended to form a magnetic field through the beam tunnel 38 in order to guide the passage of the electron beam. FIG. 8 shows that magnetic flux from the magnets 36 extends through the polepieces 32 in the X direction, shown by the arrows 46. When the flux reaches the beam tunnel 38, the lines of flux jump through the tunnel in the Z direction to the adjacent polepiece 32 and extends back through the adjacent polepiece in the X direction to the magnets 36.

As the electron beam passes through the tunnel 38, stray electrons which strike the surfaces of the beam tunnel wall produce heat within the focusing system 30. To remove the heat, a planar heat sink 54 is provided at each of the opposite sides 41 and 42 of the circuit 30. The planar heat sink 54 can be a bar of heat conductive material, such as copper, or could have an internal manifold to carry a flow of a coolant fluid. Ideally, the heat sink 54 would remain at a constant temperature so as to efficiently remove heat from the circuit 30. The heat flux travels through the spacers 34 to the heat sinks 54 in the Y direction shown by the arrows 52.

It should be readily apparent that the direction of the heat path Y is generally perpendicular to the magnetic flux travelling in the X and Z directions. The unique geometry of the circuit 30 provides distinct advantages over the cylindrical geometry of the prior art. By providing a narrow width structure with a relatively long height, the heat sinks 54 would be relatively close to the beam tunnel 38. This provides for efficient removal of heat from within the tube 30. Cavities can be formed in the spacers 34 to provide an RF path for conduction of a microwave RF signal through the tube 30. Alternatively, the tube can be shaped with the magnets 36 extending from the sides 43 and 44 inward towards the beam tunnel 38 to result in high flux density within the beam tunnel 38, while maintaining the RF path within the spacers of the tube. By placing the magnets on opposite sides of the circuit 30 and having the heat sinks 54 on different sides than the magnets 36, the magnets 36 do not interfere with the position of the heat sinks 54. Thus, tube designers can select either efficient heat removal or high magnetic flux density with this unique focusing system.

An alternative embodiment of a microwave tube having the X-Z PPM focusing system of the present invention is shown at 50 in FIG. 5. In that configuration, the beam tunnel 38 is offset from the center of the tube 50 and is substantially centered adjacent a side of the tube. Rather than having spacers 34 interposed at the center of the tube 50 as in previous embodiments, the spacers are now provided at a side of the tube. The permanent magnets 36 are provided at the other side of the circuit 50. Accordingly, the heat sinks 54 are also provided at the side adjacent to the non-magnetic spacers 34. In this embodiment, a third heat sink 54 could be placed at the bottom of the tube 50, providing heat removal from three sides. As such, the direction of the heat path would be in both X and Y directions. It should be apparent that the tube 50 would have extremely good thermal ruggedness over the earlier described microwave tube designs.

In yet another embodiment of the present invention, a plurality of tubes having the X-Z PPM focusing systems of FIG. 4 are combined into a common tube 60, as shown in FIG. 6. Each adjacent tube 30 shares a common heat sink 54. The tubes 30 could additionally share common magnet bars which extend perpendicularly across each tube, shown in phantom at 71. Since each of the adjacent tubes 30 have an independent beam tunnel 38, it should be apparent that the combined tube 60 can focus a plurality of electron beams simultaneously. Such would be desired in microwave applications having a plurality of separate RF signals, such as in a phase array radar.

To put the microwave tube 30 into use, it would be combined with an electron gun 74 and a collector 76. The electron gun 74 has an emitting surface 78 which emits the electron beam 80, that projects through the tube 30. The collector 76 receives the spent electron beam 80, after it passes through the tube.

Having thus described a preferred embodiment of a microwave tube having an X-Z PPM focusing system, it should now be apparent to those skilled in the art that the aforestated objects and advantages of the within system have been achieved. It should also be appreciated by those skilled in the art that various modifications, adaptations, and alternative embodiments thereof may be made within the scope and spirit of the present invention. For example, polepiece and spacer shapes can range from long and thin to short and fat, to provide the desired balance between thermal ruggedness and magnetic flux density. The microwave tubes configurations described above could be used in a variety of roles, including coupled cavity traveling wave tubes, klystrons or extended interaction circuits.

The present invention is further defined by the following claims:

What is claimed is:

1. An X-Z PPM focusing system for focusing an electron beam, comprising:

a tube having a plurality of magnetic polepieces interposed by non-magnetic spacers, an axially disposed beam tunnel permitting projection of said electron beam therethrough, and a thermal surface disposed on at least one side of said tube; and means for inducing a magnetic field in said tube having lines of flux which flow through said polepieces in a first axial direction and which jumps through said beam tunnel to focus said beam;

wherein, heat formed within said tube flows through said spacers to said thermal surface in a second axial direction which is non-coincident with said first direction.

2. The X-Z focusing system of claim 1, wherein said inducing means further comprises:

permanent magnets disposed externally of said circuit and mechanically coupled to said polepieces, said magnets providing said magnetic field.

3. The X-Z focusing system of claim 2, wherein:

adjacent pairs of said polepieces are coupled by individual ones of said permanent magnets, and direction of polarity of said permanent magnets alternates with each of said adjacent pairs.

4. The X-Z focusing system of claim 3, wherein:

said permanent magnets are disposed on at least one side of said tube that is substantially different from said sides providing said planar surface.

5. The X-Z focusing system of claim 2, further comprising a heat sink attached to said planar surface.

6. An X-Z focusing system for focusing an electron beam, comprising:

a tube having a plurality of magnetic polepieces interposed by non-magnetic spacers, an axially disposed beam tunnel permitting projection of said electron beam therethrough, and a thermal surface disposed on at least one side of said tube; and means for inducing a magnetic field in said tube having lines of flux which flow through said polepieces in a first general direction and which jumps through said beam tunnel to focus said beam, said including means comprising permanent magnets disposed externally of said circuit and mechanically coupled to said polepieces, said magnets providing said magnetic field;

wherein, heat formed within said tube flows through said spacers to said thermal surface in a second general direction which is non-coincident with said first direction, and at least three of said polepieces are coupled by individual ones of said permanent magnets, and polarity of said permanent magnets alternates with each of said coupled polepieces.

7. The X-Z focusing system of claim 6, wherein:

said permanent magnets are disposed on at least one side of said tube that is substantially different from said sides providing said planar surface.

8. The X-Z focusing system of claim 7, wherein said polepieces are generally rectangular.

9. A focusing system for a plurality of electron beams, the system comprising:

at least two tubes formed from a plurality of magnetic polepieces interposed by non-magnetic spacers, said tubes having axially disposed beam tunnels permitting projection of said electron beams therethrough and surfaces disposed on two sides of each of said tubes; and a means for inducing a magnetic field in said tubes having lines of flux which flow through said polepieces in a first general direction and which jumps through said beam tunnel to focus said beam, heat formed within said tubes flowing through said spacers to said planar surfaces in a second general direction which is non-coincident with said first direction;

wherein, said tubes are mechanically joined together with each adjacent pair of said tubes sharing a common heat sink therebetween, each of said tubes providing focusing for an associated one of said electron beams.

10. The focusing system of claim 9, wherein:

said inducing means comprises permanent magnets disposed externally of said plurality of circuits, said magnets being mechanically coupled to said polepieces.

11. The focusing system of claim 10, wherein:

at least two of said polepieces are coupled by individual ones of said magnets, and polarity of said magnets alternates with each other of said coupled polepieces.

12. The focusing system of claim 11, wherein:

said magnets are disposed on at least one side of said circuit that is substantially different from said sides providing said planar surface.

13. The focusing system of claim 12, wherein said permanent magnets further comprise bars which extend perpendicularly across each of said tubes, wherein individual ones of said bars provide said magnetic field for each of said tubes.

14. The focusing system of claim 13 wherein said polepieces of adjacent ones of said tubes are mechanically coupled.

15. The focusing system of claim 14, wherein said polepieces are generally rectangular.

16. The focusing system of claim 9, wherein said polepieces are formed from iron.

17. The focusing system of claim 9, wherein said spacers are formed from copper.

18. The focusing system of claim 9, further comprising a heat sink attached to said planar surfaces.

19. An electron beam focusing system, comprising:

a tube comprising a plurality of magnetic polepieces interposed by non-magnetic spacers, said tube having an axially disposed beam tunnel permitting projection of an electron beam therethrough; and means for inducing a magnetic field in said tube to focus said beam, said magnetic field having lines of flux through said polepieces along a magnetic axis, and heat generated within said tube having lines of flux through said spacers along a thermal axis;

wherein said magnetic axis is substantially perpendicular to said thermal axis.

20. The electron beam focusing system of claim 19, further comprising:

a planar surface disposed on at least one side of said tube and permitting the attachment of a heat sink thereto, said planar surface lying normal to said thermal axis.

21. The electron beam focusing system of claim 20, wherein said inducing means further comprises:

permanent magnets disposed externally of said tube and mechanically coupled to said polepieces, said magnets providing said magnetic field.

22. The electron beam focusing system of claim 21, wherein:

adjacent pairs of said polepieces are coupled by individual ones of said permanent magnets, and direction of polarity of said permanent magnets alternates with each of said adjacent pairs.

23. The electron beam focusing system of claim 22, wherein:

said permanent magnets are disposed on at least one side of said tube that is substantially different from said sides providing said planar surface.

24. The electron beam focusing system of claim 23, wherein said polepieces are formed from iron.

25. The electron beam focusing system of claim 24, wherein said spacers are formed from copper.

26. An electron beam focusing system, comprising:

a tube formed from a plurality of magnetic polepieces interposed by non-magnetic spacers, said tube having an axially disposed beam tunnel offset within said tube permitting projection of an electron beam therethrough;

thermal surfaces disposed on a plurality of sides of said tube, said surfaces permitting the attachment of heat sinks thereto, heat generated within said tube flowing through said spacers to said thermal surfaces; and a means for inducing a magnetic field in said tube to focus said beam, said magnetic field having lines of flux through said polepieces which are non-coincident with the direction of said heat flow.

27. The focusing system of claim 26, wherein said inducing means further comprises:

permanent magnets disposed externally of said tube and mechanically coupled to said polepieces, said magnets providing said magnetic field.

28. The focusing system of claim 27, wherein said magnets are disposed on a side of said tube that is different than said sides having said thermal surfaces.

29. The focusing system of claim 28, wherein there are three thermal surfaces.

30. The focusing system of claim 29, further comprising heat sinks attached to said thermal surfaces.

* * * * *